United States Patent [19]

Müller et al.

[11] Patent Number: 4,697,438

[45] Date of Patent: Oct. 6, 1987

[54] SYNCHRONIZING DEVICE FOR THE SELECTION OF KNITTING NEEDLES IN KNITTING MACHINES

[75] Inventors: Hartwig Müller; Claus Hellwig; Dietmar Beyer, all of Karl Marx Stadt, German Democratic Rep.

[73] Assignee: VEB Kombinat Textima, Karl Marx Stadt, German Democratic Rep.

[21] Appl. No.: 906,915

[22] Filed: Sep. 11, 1986

[30] Foreign Application Priority Data

Sep. 27, 1985 [DD] German Democratic Rep. ... 281090

[51] Int. Cl.[4] ..... D04B 15/70; D04B 15/78; D04B 7/28

[52] U.S. Cl. ..... 66/75.2; 66/219

[58] Field of Search ..... 66/75.2, 219

[56] References Cited

U.S. PATENT DOCUMENTS

| | | | |
|---|---|---|---|
| 3,782,136 | 1/1974 | Ploppa et al. | 66/75.2 |
| 3,972,208 | 8/1976 | Ferrington | 66/219 |
| 4,006,611 | 2/1977 | Kahan et al. | 66/75.2 |
| 4,081,974 | 4/1978 | Jaffe et al. | 66/75.2 |
| 4,222,247 | 9/1980 | Hashimoto et al. | 66/75.2 |
| 4,312,194 | 1/1982 | Cotte et al. | 66/75.2 |
| 4,324,115 | 4/1982 | Krause | 66/75.2 |

FOREIGN PATENT DOCUMENTS 2919369 11/1980 Fed. Rep. of Germany .

*Primary Examiner*—Wm. Carter Reynolds
*Attorney, Agent, or Firm*—Michael J. Striker

[57] ABSTRACT

A synchronizing device for the selection of individual knitting needles in a straight and circular knitting machine to operate according to a desired knitting pattern includes a synchronizing rail of a magnetizable material arranged on a stationary selection needle bed and cooperating with a magneto-resistive sensor arranged on a circulating knitting carriage. The sensor includes a permanent magnet whose magnetix flux is directed perpendicularly to the synchronizing rail, and four magneto-resistive webs arranged side by side in the magnetic flux and at right angles to the direction of circulation of the carriage. The webs are connected in a bridge circuit generating positive and negative analog signals which are compared in comparators with fixed threshold values to generate leading and trailing synchronizing pulses. An additional comparator is provided for detecting the direction of circulation of the carriages.

5 Claims, 3 Drawing Figures

SYNCHRONIZING DEVICE FOR THE SELECTION OF KNITTING NEEDLES IN KNITTING MACHINES

BACKGROUND OF THE INVENTION

The present invention relates in general to a knitting machine, in particular to a synchronizing device for the selection of knitting needles in flat or straight and circular knitting machines of the type having two pairs of needle beds arranged in tandem, knitting carriage circulating in one direction above the needle beds, each carriage supporting a device for selecting the knitting needles according to a desired pattern, the selecting device including a set of selection cams movable between a neutral and an active position, a set of solenoids for controlling the position of respective cams, means including a pulse generator for controlling actuation of selected solenoids, a pin board arranged in the path of movement of the selection cams and guiding a set of selection pins, and blade beds arranged on the needle beds and each including a set of Jacquard-type sinking blades assigned to respective knitting needles and being controlled by the selection pins.

From prior art it is known how to select by means of selecting devices arranged on knitting carriages sinking blades for an auxiliary needle bed so as to control the individual knitting needles. In order to insure correct time points of the generation of control pulses by the selection devices, there are provided synchronizing devices consisting of pulse generators and synchronizing rails. The synchronizing rails have been integrally formed in the needle- or sinking blade beds or can be arranged on the knitting machine separately. For example, according to the German publication DE-OS No. 2919369 there is provided a pulse generator in the form of a disc cooperating with at least one, usually with two, pulse generators. The disc is arranged above the needle beds and is driven by a transmission chain synchronously with the carriages. From the German Pat. No. 2,114,013 known are also optical means for generating synchronizing pulses. In practice, such prior art solutions have been successful in flat knitting machines because they guarantee an error-free selection of the knitting needles, and consequently a high knitting quality.

However, in straight and circular knitting machines operating with two beds of knitting needles arranged one after the other and using circulating carriages, the application of prior art solutions of selecting devices is not possible without further measures. Due to the two independent pairs of needle beds with corresponding different guiding tracks for the carriages, there result higher mechanical tolerances leading to higher timing tolerances for synchronization. Consequently, limitation of operating speed of the straight and circular knitting machines using circulating carriage would result. In addition, in the prior art solution using a chain power transmission from a drive to the knitting carriage, undesirable irregularities in the run of respective knitting carriages may occur especially upon braking the knitting machine a certain amount of kickback takes place. In order to reduce errors resulting from this kickback, it has been necessary to use always two spatially staggered pulse generators in order to recognize the direction change. In the case of straight and circular knitting machines it would be necessary to further increase the number of pulse generators and further component parts, which would impair the reliability and the efficiency of the knitting operation. So far, no measures have been devised how to improve the situation in circular knitting machines.

SUMMARY OF THE INVENTION

It is, therefore, a general object of the present invention to overcome aforementioned the disadvantages.

In particular, it is an object of this invention to provide an error free selection of individual needles even in the straight and circular knitting machines using two pairs of needle beds arranged in tandem and knitting carriages circulating in one direction.

Another object of this invention is to provide such an improved synchronizing device which does not limit the maximum operating speed of the knitting machine.

Another object of this invention is to provide such an improved synchronizing device which accurately operates even under increased mechanical play or tolerances resulting from the particular type of the knitting machine.

Still another object of this invention is to provide a synchronizing device which with minimum technological expenditures detects reversal in the direction of movement of the knitting carriages and prevents possible synchronization errors.

In keeping with these objects and others which will become apparent hereafter, one feature of this invention resides, in the provision of sensing means which in accordance with their physical operational properties are arranged in such a manner as to provide synchronizing signals which act on mechanically controlled selection cams without tolerances and immediately before the desired time point of actuation of selected individual needles or immediately after the desired time point of inactivation of the selected needle. Preferably, the sensing means use magneto - resistive sensors on the circulating carriages whose output signals are electonically evaluated to detect accurately the momentary positions of the carriage relative to the needles and to generate synchronizing signals which guarantee a reliable selection of individual needles according to a desired motive or pattern and also to generate a monitoring signal which detects any reversal in the movement of the carriages.

According to this invention, the selection pin beds support synchronizing rails of a magnetizable material formed with a series of slots spaced in accordance with the division of the needles in the needle beds, the series extending in the direction of movement of the carriages, the sensors being arranged on the carriages opposite the slots to detect magnetization changes in the rails caused by the slots during the circulation of the carriages and to generate corresponding analog signals, the analog signals being applied to electronic evaluation means which generate at its output synchronizing signals when the analog signals exceed a predetermined threshold value, and the synchronizing signals being applied to the controlling means to trigger the actuation of selected selection cams. The electronic evaluation means also derive from the analog signals a direction monitoring signal which during the forward direction trails the synchronizing signals whereas during the reverse direction it leads the synchronizing signal.

The slots in the synchronizing rails define when viewed in the direction of rotation of the carriages a leading flank and a trailing flank, and the sensor generate leading analog signal in response to the detection of the leading flank, and a trailing analog signal in response to the trailing flank and the corresponding synchronizing signals are applied to the controlling device to trigger actuation pulses for solenoids which in turn activate the selection cams. In high speed knitting machines, the leading synchronizing pulse is applied to the solenoid at an instant when the corresponding selection cam is still in engagement with the preceding selection pin and the trailing synchronizing pulse is applied immediately upon the disenagagement of the cam from the preceding pin. Each sensor consists of an elongated web of magneto -resistive material whose electrical resistance depends on the applied magnetic field. In the preferred embodiment, four magneto -resistive webs are arranged side by side transversely to the direction of movement of the knitting cage. A permanent magnet is arranged above the sensing webs and is oriented such that its magnetic field passes through the sensing webs in a perpendicular direction toward the synchronizing rail. Analog signals from the bridge connected sensing webs are applied to an electronic evaluation device including three operational amplifiers where the analog signals are compared with two reference or threshold values and release corresponding pulses when the positive analog signal exceeds a positive reference voltage and negative power signal drops below the negative threshold voltage. Analog signal derived from the detection of the leading flank of the slot is applied to the third operational amplifier where it is compared with another threshold value to generate direction monitoring signal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
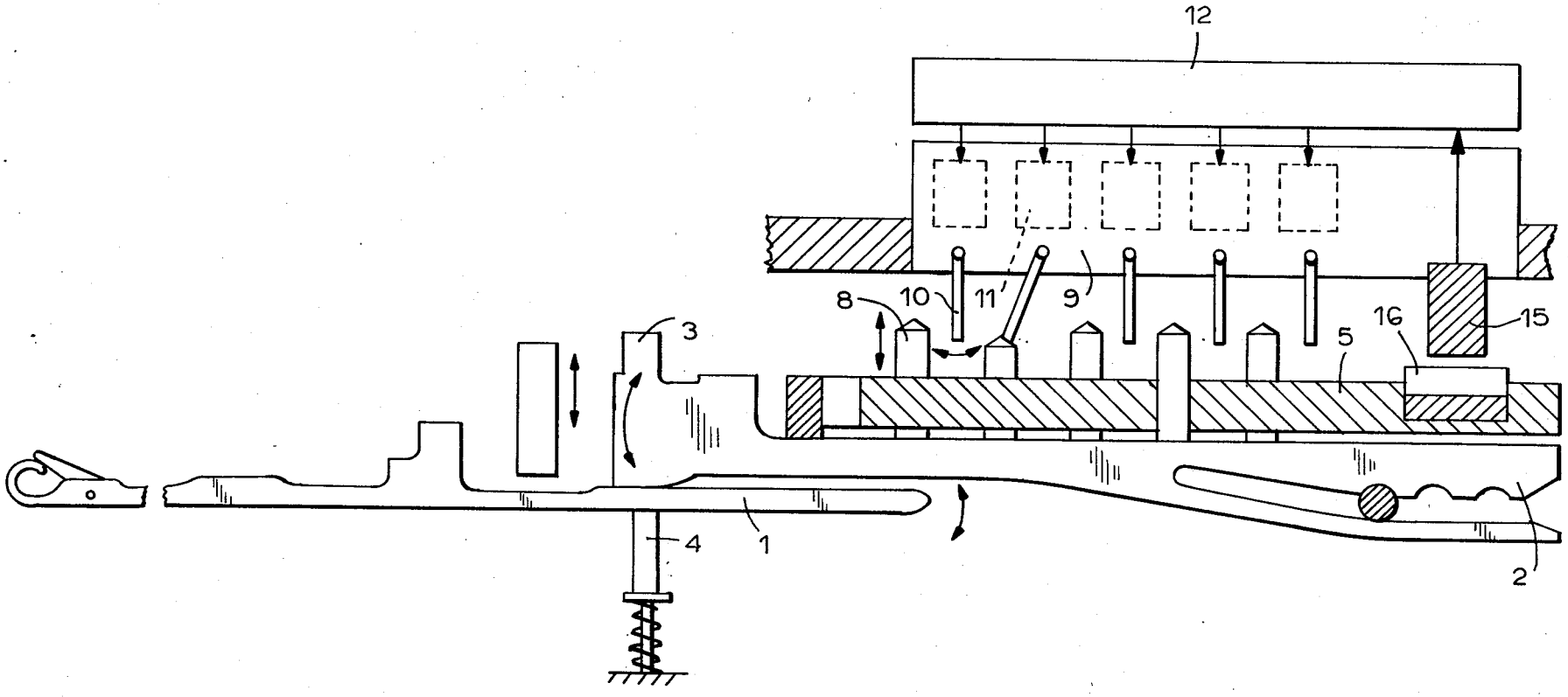
FIG. 1 shows schematically in a sectional view a part of a straight and circular knitter including the synchronizing device of this invention.

Referring firstly to FIG. 1, the illustrated part of a straight and circular knitting machine includes knitting needles 1 arranged in a needle bed adjacent to non-illustrated latch closing means. The needle bed includes spring biased bolts 4 engaging from below respective needles to counteract foot 3 of a Jacquard sinker blade 2 which sinks the needle from the range of the latch closing means when actuated. The sinking blades 2 are located below a selection pin board 5. The board 5 is formed with an array of staggered holes opening to respective grooves in needle beds to guide selection pins 8 freely inserted in the holes. Each selection pin rests on an assigned sinker blade 2 and accordingly when depressed it moves the foot 3 to lower the corresponding needle. The pins 8 are selectively depressed according to a desired pattern by a selecting device 9 supported on a knitting carriage. The selecting device includes a set of selection cams 10 pivotably supported on the carriage and being controlled by solenoids 11 to move between a disengaged position in which the cam is spaced apart from the selection pins 8, and an engaging position in which during the rotation of the carriage the cam is tilted into engagement with an assigned selection pin 8. The solenoids 11 are energized in accordance with a desired knitting pattern by actuation signals from a control device 12 which cooperates with a synchronizing device shown schematically in FIGS. 2 and 3.

Figure 2:
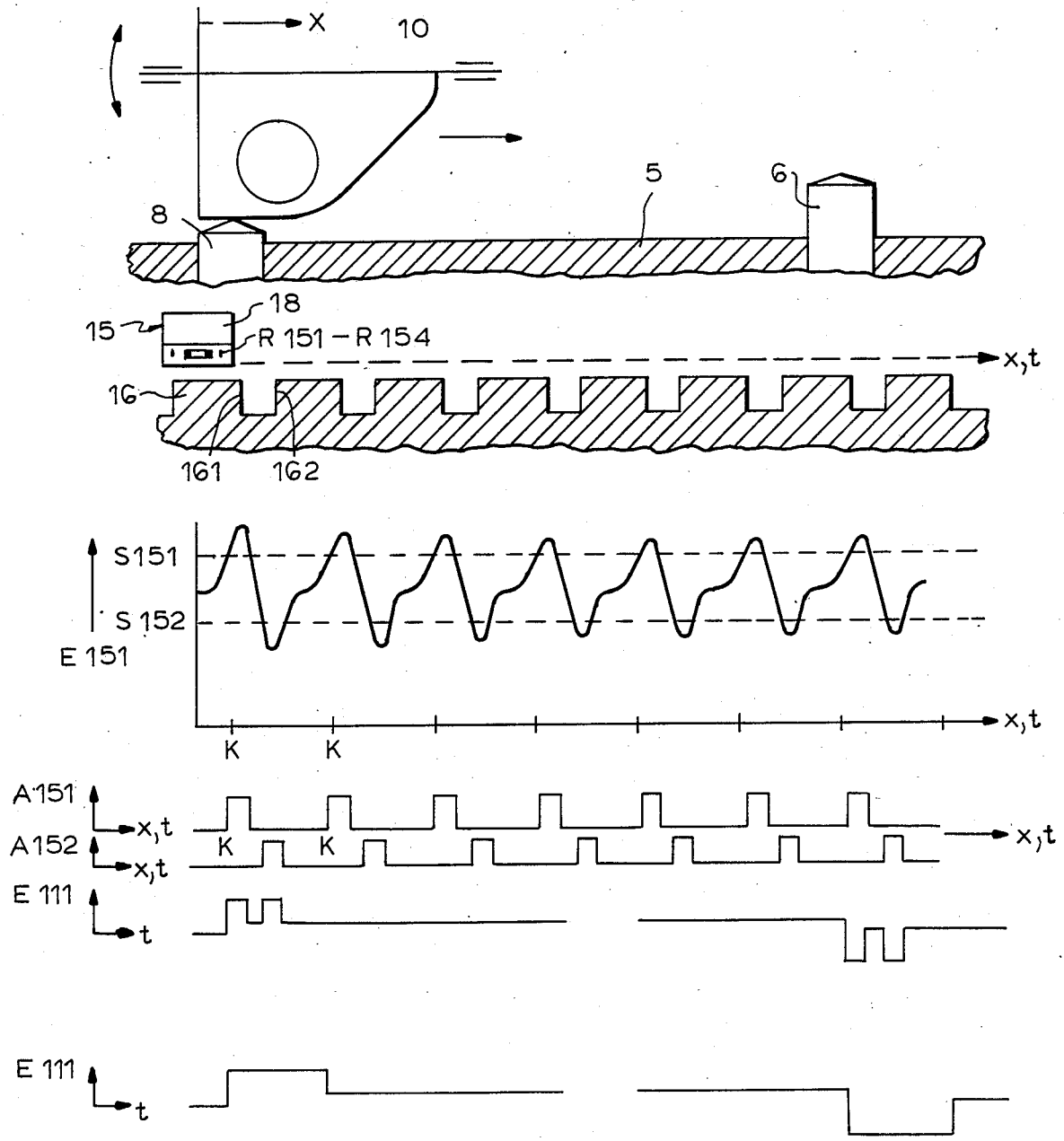
FIG. 2 shows schematically the time diagram of the generation of analog pulses for magneto- resistive sensors, synchronizing the digital pulses and actuation pulses for selection cams controlling solenoids.
Figure 3:
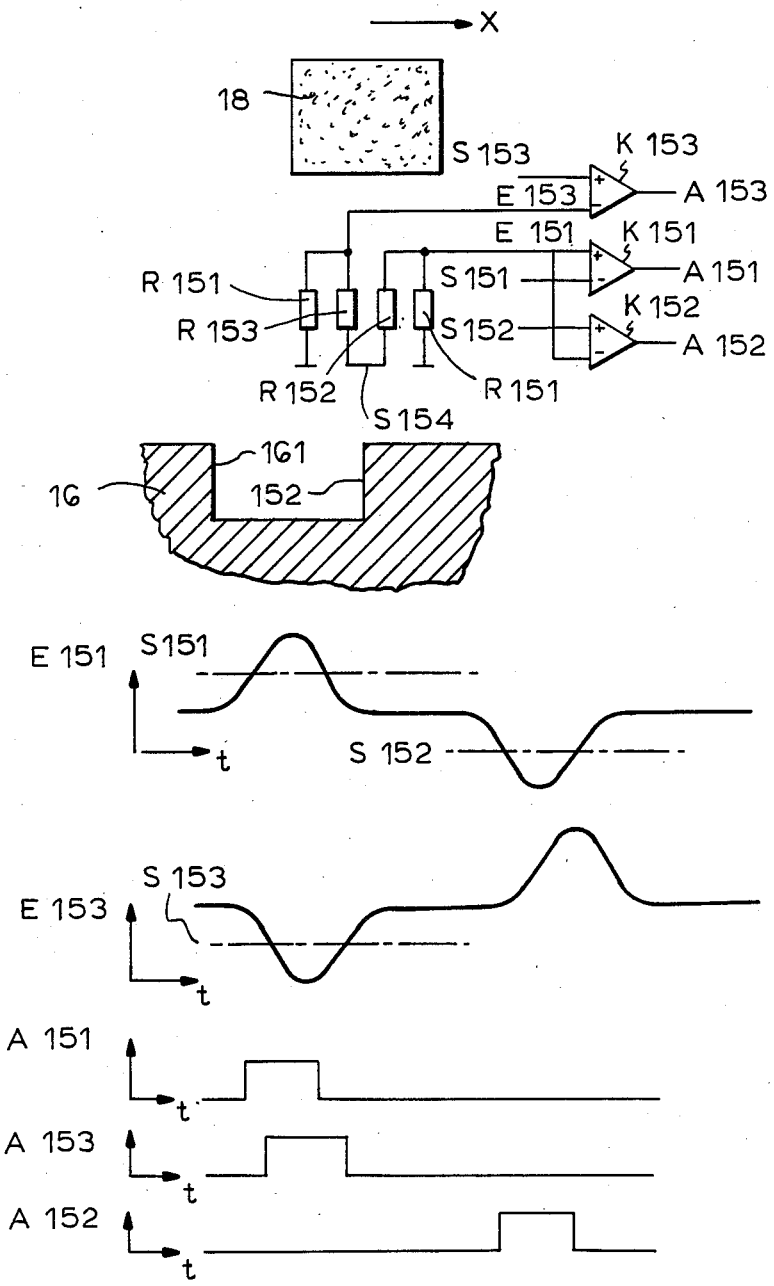
FIG. 3 shows the arrangement and operation of the sensors.

Referring to FIGS. 1 and 2, the synchronizing device includes a magneto- resistive sensor 15 suspended on the knitting carriage and a synchronizing rail 16 supported on the selection pin board 5 below the path of movement of the sensor 15. The synchronizing rail 16 is formed with a series of slots separated from one another in accordance with the needle grooves of the needle beds and each having a leading flank 161 and a trailing flank 162 when viewed in the direction of movement of the sensor 15. As shown in FIG. 3, the sensor 15 includes a permanent magnet 18 and four elongated magneto- resistive sensors R151 to R154 located below the permanent magnet 18. The four magneto -resistive sensors are arranged side by side transversely to the direction of movement of the knitting carriage indicated by arrow X such that magnetic flux from the permanent magnet passes therethrough in vertical direction against the synchronizing rail 16 which is made of a magnetizable material. The sensor 15 is electrically connected to an electronic evaluation device including three comparators K151 to K153. A diagonal of the bridge circuit R151 through R154 is grounded and connected to a measuring voltage S154 whereas connection point between the magneto resistive sensor, webs R151 and R152 is connected to non-inverting input of comparator K151 and the connection point between R153 and R154 is connected to the inverting input of comparator K153 to apply thereto an analog signal E151 and E153, respectively. The sensing magneto-resistive webs, as mentioned before, are oriented at right angles both the direction of movement of the permanent magnet and to the direction of the magnetic flux thereof.

To select individual needles 1 according to a desired knitting pattern, the control device 12 during the movement of the carriage delivers to solenoids 11 corresponding actuation signals in such an order as to tilt the selection cams 10 in accordance with the desired pattern. The selectively tilted cams depress during the rotation time t of the carriage those pins 8 which lie in the path of their movement and consequently the corresponding knitting needles 1 are displaced by the foot 3 of the sinker blade 2 out of the range of the latch closing means. This selection process takes place during the circulation of the cams in the direction X between the array of selection pins 8.

In order to insure correct time points for the release of solenoid actuation pulses according to the predetermined knitting pattern, the control device 12 triggers these actuation pulses in response to the synchronizing signals A151 and A153 coinciding with the detection of flanks 161 and 162 of the synchronizing slots by the sensor 15.

The positive analog voltage E151 has its peak when the leading magneto - resistive web R151 slips past the flank 161. In this example, the positive pulse E151 is used for disengaging an activated cam 10 from a selection pin 8 and triggers via the control device an actuation pulse for a corresponding solenoid at a time point when the assigned cam 10 is still in engagement with the pin 8. Alternatively, the synchronizing pulse tilts the cam 10 into its engaging position in the spatial interval between two consecutive selection pins immediately after passing the leading pin well in advance of the following pin to be activated.

The synchronizing rectangular signal A151 is obtained by comparing the analog voltage E151 with a constant continuously applied reference or threshold voltage S151 in comparator K151 and the signal A151 is applied to the actuation controlling device 12. Accordingly even at a normal high operational speed of the knitting machine, the synchronizing signal A151 guarantees that the control device delivers its actuation pulse at a time point k which allows sufficient time for building up the full magnetic force of the solenoid and the concurrent tilting of the cam 10 before reaching the assigned selection pin 8 . In this manner the cam depresses without any delay and with full force the pin 8, the sinker plate 2 and the corresponding needle 1.

The negative pulse of the analog voltage E151 results from the detection of the trailing flank 162 and serves for rapid triggering of the actuation pulse for solenoid 11 even during low operational speed of the knitting machine occurring for example during braking or starting operations. By comparing the analog voltage E151 from the bridge branch R151, R152 with a reference voltage S152 in comparator K152, a corresponding synchronizing signal A152 is generated and applied to the control device 12. It will be seen on the time axis t' in FIG. 2, the negative pulse of analog voltage E151 triggers a repeated actuation pulse E111. At low operational speeds of the knitting machine, the short leading actuation pulse E111 is ineffective and only the subsequent actuation pulse causes a timely engagement of the cam 10 with the corresponding pin. In this manner a reliable synchronization and selection of individual needles even at low knitting speeds is made possible. The minute time gap between the synchronizing pulses A151 and A152 is negligible.

At high knitting speeds it is the leading synchronizing signal A151 which is effective in activating the cams and the subsequent synchronizing signal A152 is nearly superposed. Accordingly, the actuation voltage E111 across the solenoid is prolongated in time (after triggering).

Comparator K153 serves for evaluating the direction of movement of the knitting carriage. The comparator K153 compares analog voltage E153 branched at the connection point of magneto- resistive webs R153 and R154 with a reference voltage 153 and delivers a digital monitoring signal A153. When the carriage circulates in the direction X, the monitoring signal trails behind the synchronizing signal A152. However, when the direction of movement of the carriage is reversed, the monitoring signal A153 preceeds the synchronizing signal A152 and by means of a known blocking circuit it prevents for the duration of the backward movement the reception of further synchronizing signals A151, A152, thus avoiding false actuations. In the case of the forward movement of the knitting carriage, the monitoring signal A153 occurs after the leading synchronizing signal A151 and backs up the correct needle selection according to the desired motive.

While the invention has been illustrated and described as embodied in a specific example of a synchronizing device using magnetor resistive sensing elements, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A synchronizing device for the selection of knitting needles in a knitting machine of the type having a needle bed and a knitting carriage circulating in one direction above the needle bed, the carriage supporting a device for selecting knitting needles in the needle bed in accordance with a desired pattern, the selecting device including a set of selection cams movable between neutral and an active position, a set of solenoids coupled to respective cams for moving the same into one of said positions, means for controlling actuation of said solenoids according to the desired pattern, a pin board including a set of selection pins arrranged between said cams, said sams in the active position thereof being engageable with assigned selection pins; a blade bed arranged on the needle bed and including a set of Jacquard-type sinking blades assigned to respective knitting needles and being controlled by said selection pins; the synchronizing device comprising a synchronizing rail of a magnetizable material supported on said pin board, said synchronizing rail being formed with a series of slots spaced in accordance with the division of knitting needles in the needle bed, the series of slots extending in the direction of movement of the carriage; sensing means arranged on the carriage opposite said slots for detecting during circulation of said carriage magnetization changes in said rail to generate corresponding analog signals; and evaluation means for generating from said analog signals corresponding synchronizing signals when said analog signals exceed predetermined values, said synchronizing signal being applied to said controlling means to trigger selected solenoids.

2. A synchronizing device as defined in claim 1, wherein each of said slots has a leading flank and a trailing flank when viewed in the direction of circulation of said carriage, said sensing means generating a leading analog signal in response to the detection of said leading flank when a corresponding selection pin to be released is still in engagement with a cam, and generating analog signal in response to the trailing flank before a corresponding selection pin to be activated reaches its assigned cam.

3. A synchronizing device as defined in claim 1, wherein said evaluation means further generates in response to a reversal of the direction of circulation of said carriage a synchronization control signal.

4. A synchronizing device as defined in claim 3, wherein said sensing means includes a permanent magnet for directing at right angles to said synchronizing rail magnetic flux against said slots, four elongated sensors of magneto-resistive material arranged side by side in said magnetic flux transversely to the direction of circulation of said carriage to sense leading and trailing edges of said slots, said magneto-resistive sensors being electrically connected in a bridge circuit to generate positive and negative analog signals during circulation of said carriage; said evaluation means including comparators for comparing said positive and negative analog signals with said predetermined values to generate leading and trailing synchronizing pulses.

5. A synchronizing device as defined in claim 4, wherein said evaluation means further includes an additional comparator connected to a branch of said bridge circuit between the trailing magneto-resistive sensors to compare the corresponding analog signal with said synchronizing signals to generate a synchronization controlling signal.

* * * * *